US009623275B2

(12) United States Patent
Reid

(10) Patent No.: US 9,623,275 B2
(45) **Date of Patent: *Apr. 18, 2017**

(54) DUMBBELL CASTOR EXERCISE DEVICE

(75) Inventor: Michael S. Reid, Lake Stevens, WA (US)

(73) Assignee: BODY KINETICS, INC., Brier, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/459,087

(22) Filed: Apr. 28, 2012

(65) Prior Publication Data

US 2012/0295775 A1 Nov. 22, 2012

Related U.S. Application Data

(60) Provisional application No. 61/488,740, filed on May 21, 2011.

(51) Int. Cl.

| | |
|---|---|
| ***A61H 3/04*** | (2006.01) |
| ***A63B 22/20*** | (2006.01) |
| ***A63B 21/072*** | (2006.01) |
| ***A63B 21/075*** | (2006.01) |
| ***A63B 23/12*** | (2006.01) |

(52) U.S. Cl.

CPC ..... *A63B 21/0726* (2013.01); *A63B 22/20* (2013.01); *A63B 22/203* (2013.01); *A63B 23/1236* (2013.01)

(58) Field of Classification Search

CPC . A63B 23/02; A63B 23/0205; A63B 23/1236; A63B 23/1245; A63B 21/072; A63B 21/0276; A63B 22/20; A63B 22/0726; A63B 22/203; A63B 21/0726; A63B 21/0722; A63B 21/0724; A63B 21/0728

USPC ..... 482/106, 108, 141, 49, 50, 44, 92, 482/131–133, 135–137

See application file for complete search history.

(56) References Cited

U.S. PATENT DOCUMENTS

| | | | | |
|---|---|---|---|---|
| 3,363,735 | A * | 1/1968 | Hotchkiss | 193/37 |
| 3,622,152 | A | 11/1971 | Place | |
| 3,789,947 | A * | 2/1974 | Blumrich | 180/6.48 |
| 3,809,393 | A * | 5/1974 | Jones | 482/132 |
| 4,335,899 | A * | 6/1982 | Hiscock | B60B 3/082 280/259 |
| 4,892,305 | A | 1/1990 | Lynch | |
| D309,254 | S | 7/1990 | Guile | |
| 5,064,045 | A | 11/1991 | Leon | |

(Continued)

OTHER PUBLICATIONS http://www.merriam-webster.com/dictionary/end (c)2014 Merriam-Webster, Inc.*

(Continued)

*Primary Examiner* — Loan H Thanh
*Assistant Examiner* — Nyca T Nguyen
(74) *Attorney, Agent, or Firm* — Mark P. Walters; Lowe Graham Jones PLLC

(57) ABSTRACT

A dumbbell caster assembly includes a first omnidirectional wheel assembly mechanically coupled to a grip. A second omnidirectional wheel assembly is mechanically coupled to the grip. The omnidirectional wheel assemblies can include a plurality of wheel sub-wheels. The dumbbell caster assembly allows a user to perform exercises, such as push-up exercises and abdominal exercises, that require omnidirectionality.

3 Claims, 2 Drawing Sheets

(56) References Cited

U.S. PATENT DOCUMENTS

| | | | | |
|---|---|---|---|---|
| 5,323,867 | A * | 6/1994 | Griffin | B25J 5/007 180/22 |
| 6,857,707 | B2 | 2/2005 | Guile | |
| 7,011,610 | B2 | 3/2006 | Wawrzyniak | |
| 7,293,790 | B2 * | 11/2007 | Byun | B60B 19/003 180/6.2 |
| 7,566,102 | B2 * | 7/2009 | Guile | 301/5.23 |
| 7,621,858 | B2 | 11/2009 | Sheron | |
| 7,935,039 | B2 | 5/2011 | Dannenberg | |
| D654,545 | S | 2/2012 | Richard | |
| 2009/0278325 | A1 * | 11/2009 | Geels | A61H 3/04 280/5.28 |
| 2010/0130337 | A1 * | 5/2010 | Stewart | 482/121 |
| 2013/0012369 | A1 | 1/2013 | Prest | |
| 2013/0023391 | A1 | 1/2013 | Nicholas | |
| 2013/0237392 | A1 | 9/2013 | Reid | |

OTHER PUBLICATIONS

Official Communication for U.S. Appl. No. 13/871,736 mailed Sep. 11, 2013.

* cited by examiner

DUMBBELL CASTOR EXERCISE DEVICE

CROSS REFERENCE TO RELATED APPLICATIONS

This application claims priority to U.S. Provisional Patent Application No. 61/488,740 filed on May 21, 2011.

FIELD OF THE INVENTION

This invention relates to exercise equipment.

BACKGROUND OF THE INVENTION

In the fitness equipment industry there are many different types of push up exercise devices that seek to improve the overall effectiveness of a push-up exercise. There are also devices that seek to improve on abdominal exercises. Some of the push-up exercise devices move from side to side or rotate about a vertical axis in order to increase the resistance of a push up exercise. There are also abdominal exercise devices that roll to improve the effectiveness and increase the resistance of abdominal exercises. However, there is a current need for a push up exercise device and an abdominal exercise device that allows for movement in all directions and while providing rotation thereby improving the effectiveness of a push-up exercise and an abdominal exercise in one device.

BRIEF SUMMARY OF THE INVENTION

A dumbbell caster assembly comprises a first omnidirectional wheel assembly mechanically coupled to a grip. A second omnidirectional wheel assembly is mechanically coupled to the grip.

BRIEF DESCRIPTION OF THE SEVERAL VIEWS OF THE DRAWINGS

Figure 1:
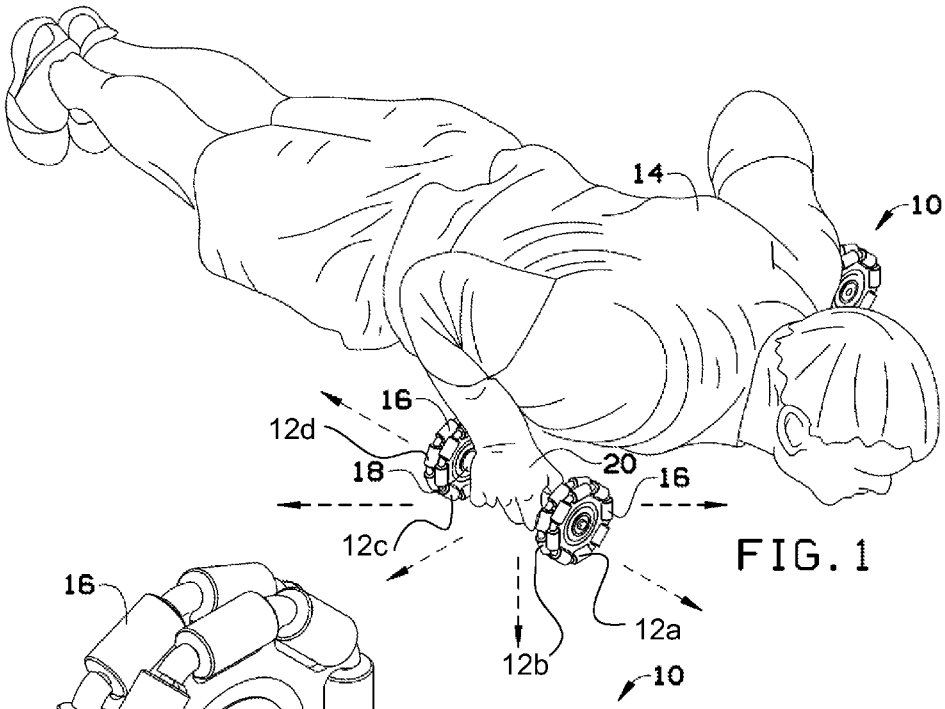

Having thus described the invention in general terms, reference will now be made to the accompanying drawings, which are not necessarily drawn to scale, and wherein:

FIG. 1 is a perspective view of the invention shown in use.

Figure 2:
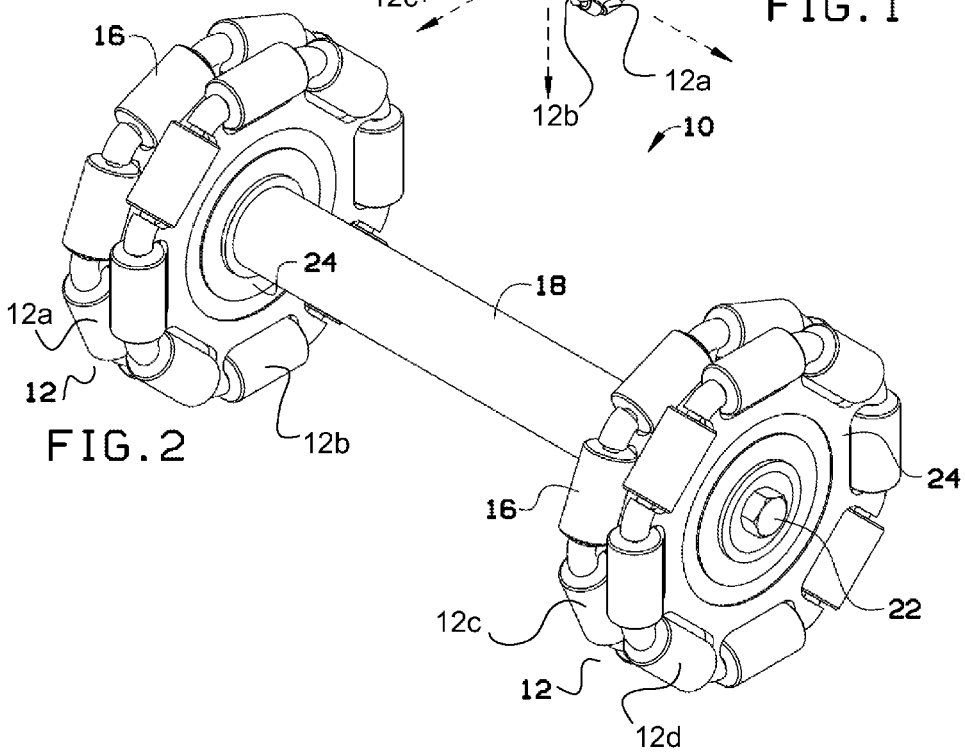

FIG. 2 is a perspective view of the invention.

Figures 3, 4:
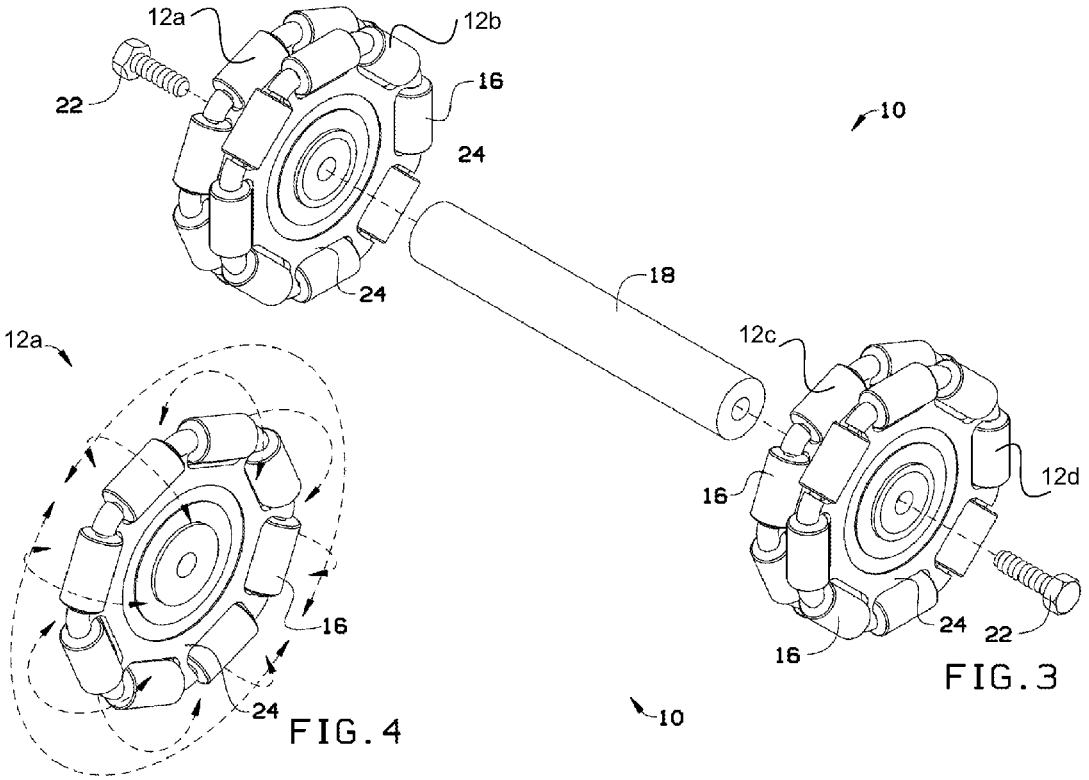

FIG. 3 is an exploded view of the invention

FIG. 4 is a perspective detail view of the invention intentionally illustrating half of the omnidirectional wheel assembly for clarity.

DETAILED DESCRIPTION OF THE INVENTION

Embodiments of the present invention overcome many of the obstacles associated with a push-up device that can also function as abdominal device, and now will be described more fully hereinafter with reference to the accompanying drawings that show some, but not all embodiments of the claimed inventions. Indeed, the invention may be embodied in many different forms and should not be construed as limited to the embodiments set forth herein. Rather, these embodiments are provided so that this disclosure will satisfy applicable legal requirements. Like numbers refer to like elements throughout.

FIG. 1 shows the invention in use. User 14 desires to do push-up exercises using hands 20, which will strengthen the user's chest, the user's abdomen or both. User 14 accomplishes this with dumbbell castor assembly 10. Dumbbell castor assembly 10 comprises a first omnidirectional wheel assembly 12*a*, a second omnidirectional wheel assembly 12*b*, a third omnidirectional wheel assembly 12*c* and a fourth omnidirectional wheel assembly 12*d* which further comprises omnidirectional wheel sub-wheel 16. The first omnidirectional wheel assembly 12*a*, the second omnidirectional wheel assembly 12*b*, the third omnidirectional wheel assembly 12*c* and the fourth omnidirectional wheel assembly 12*d* are mechanically coupled to grip 18 as shown in FIG. 3.

FIG. 2 shows dumbbell castor assembly 10 in more detail. Omnidirectional wheel assemblies 12*a* and 12*b* comprises omnidirectional wheel sub-wheel 16 and omnidirectional wheel drum 24. The first omnidirectional wheel assembly 12*a*, the second omnidirectional wheel assembly 12*b*, the third omnidirectional wheel assembly 12*c* and the fourth omnidirectional wheel assembly 12*d* are mechanically coupled to grip 18 with fastener 22 as shown in FIG. 3. Similarly, the first omnidirectional wheel assembly 12*a* comprises a first omnidirectional wheel sub-wheel 16, the second omnidirectional wheel assembly 12*b* comprises a second omnidirectional wheel sub-wheel 16, the third omnidirectional wheel assembly 12*c* comprises a third omnidirectional wheel sub-wheel 16 and the fourth omnidirectional wheel assembly 12*d* comprises a fourth omnidirectional wheel sub-wheel 16.

FIG. 3 shows index loaded assembly drawing of dumbbell castor assembly 10. Omnidirectional wheel assembly 12*a* is mechanically coupled to grip 18 by fastener 22. As noted in FIG. 4, this construction technique allows for omnidirectional movement of dumbbell castor assembly 10. While four omnidirectional wheel assemblies 12*a*, 12*b*, 12*c*, and 12*d* are shown in the figure in the construction can be done with any number of omnidirectional wheel assembly combinations. These components can be made from a large number of materials including steel, aluminum, stainless steel, wood, plastic or any other material.

FIG. 4 displays the omnidirectional nature of omnidirectional wheel assembly 12*a*. Note that omnidirectional wheel drum 24 enables omnidirectional wheel assembly 12*a* to rotate in the horizontal direction. Similarly, omnidirectional wheel sub-wheel 16 enables omnidirectional wheel assembly 12*a* to rotate in a vertical direction. These two movements work in conjunction to allow dumbbell castor assembly 10 to be used as an abdominal exercise device or a push-up exercise device.

That which is claimed:

1. A dumbbell caster assembly comprising, a grip, the grip having a first end and a second end;

a first omnidirectional wheel assembly mechanically coupled to the first end of the grip at a center of the first omnidirectional wheel assembly;

a second omnidirectional wheel assembly mechanically coupled to the second end of the grip at a center of the second omnidirectional wheel assembly, where the grip has a longitudinal axis extending from the first end of the grip to the second end of the grip, and wherein the first and second omnidirectional wheel assemblies have an axis of rotation that is about and around the longitudinal axis of the grip;

wherein the grip includes a length comprising the longitudinal axis, the length interposed between the first omnidirectional wheel assembly and the second omnidirectional wheel assembly, the length is usable for gripping and configured to receive the hand of a user for moving the caster assembly on a surface during exercising, wherein each omnidirectional wheel assembly comprises a wheel drum having a circumference and a plurality of wheel sub-wheels disposed around the circumference of the wheel drum and wherein each sub-wheel of each omnidirectional wheel assembly has an axis of rotation that is orthogonal to the axis of rotation of the wheel drum of each omnidirectional wheel assembly.

2. A method of exercising comprising the step of rotating the wheel assemblies, drums, and sub-wheels of the dumbbell caster assembly of claim 1.

3. The dumbbell caster assembly of claim 1, wherein the dumbbell caster assembly allows for movement in all directions on the surface by the user.

* * * * *